US009047754B2

(12) United States Patent
Kim

(10) Patent No.: US 9,047,754 B2
(45) Date of Patent: Jun. 2, 2015

(54) LIGHTING SYSTEM FOR LIGHT EMITTING DIODE HAVING GAS DETECTION FUNCTION

(71) Applicant: SAMSUNG ELECTRONICS CO., LTD., Suwon-si, Gyeonggi-do (KR)

(72) Inventor: Jung Hoon Kim, Hwasung (KR)

(73) Assignee: SAMSUNG ELECTRONICS CO., LTD. (KR)

( * ) Notice: Subject to any disclaimer, the term of this patent is extended or adjusted under 35 U.S.C. 154(b) by 146 days.

(21) Appl. No.: 13/900,528

(22) Filed: May 22, 2013

(65) Prior Publication Data

US 2014/0009295 A1 Jan. 9, 2014

(30) Foreign Application Priority Data

Jul. 9, 2012 (KR) ..... 10-2012-0074593

(51) Int. Cl.

| | |
|---|---|
| ***G08B 21/18*** | (2006.01) |
| ***F21V 33/00*** | (2006.01) |
| ***G08B 21/14*** | (2006.01) |
| *F21Y 101/02* | (2006.01) |

(52) U.S. Cl.

CPC ..... *G08B 21/18* (2013.01); *F21V 33/0076* (2013.01); *G08B 21/14* (2013.01); *F21Y 2101/02* (2013.01)

(58) Field of Classification Search

CPC .... G08B 21/18; G08B 17/117; G06F 17/246; G01M 3/16; G01M 3/20; G01N 27/18

See application file for complete search history.

(56) References Cited

U.S. PATENT DOCUMENTS

| | | | | |
|---|---|---|---|---|
| 4,369,647 | A * | 1/1983 | Shigemori et al. | 73/25.03 |
| 2006/0218987 | A1* | 10/2006 | Campman | 73/23.2 |
| 2008/0182215 | A1* | 7/2008 | Sid | 431/18 |
| 2009/0087640 | A1* | 4/2009 | Li et al. | 428/304.4 |
| 2011/0086247 | A1* | 4/2011 | Keshavarz et al. | 429/9 |
| 2011/0096457 | A1* | 4/2011 | Gefter et al. | 361/230 |

FOREIGN PATENT DOCUMENTS

| | | | |
|---|---|---|---|
| JP | 2010160750 | A | 7/2010 |
| KR | 20070074726 | A | 7/2007 |
| KR | 20080102559 | A | 11/2008 |
| KR | 20110115255 | A | 10/2011 |

OTHER PUBLICATIONS

King, Luminous Intensity of an LED as a Function of Input Power, Jun. 2008, ISB Journal of Physics, pp. 1-4.*

* cited by examiner

*Primary Examiner* — George Bugg
*Assistant Examiner* — Renee Dorsey
(74) *Attorney, Agent, or Firm* — Renaissance IP Law Group LLP

(57) ABSTRACT

A light emitting diode (LED) lighting system having a gas detection function may be used not only for lighting but also for detection of volatile organic compounds (VOCs) causing the sick house syndrome at home and other odorless and colorless non-combustible gas harmful to a human body. The LED lighting system may be used as an optical sensor showing with the fast response time and high sensitivity with respect to an environment harmful to a human body. In addition, since the presence of gas can be easily detected through a change of color in comparison to sound alarms for fire and gas contamination, emergency situations can be effectively handled.

10 Claims, 15 Drawing Sheets

LIGHTING SYSTEM FOR LIGHT EMITTING DIODE HAVING GAS DETECTION FUNCTION

CROSS-REFERENCE TO RELATED APPLICATION

This application claims the benefit of Korean Patent Application No. 10-2012-0074593, filed on Jul. 9, 2012, in the Korean Intellectual Property Office, the disclosure of which is incorporated herein by reference.

BACKGROUND

1. Technical Field

The present disclosure relates to a light emitting diode (LED) lighting system having a gas detection function, and more particularly, to an LED lighting system having a gas detection function, capable of optically detecting generation of gas through emission or interruption of light, color change, and the like.

2. Description of the Related Art

A liquid crystal display (LCD) may be classified into a reflection type, a transmission type, and a combination of those two types. A light emitting apparatus used in the transmission type is referred to as a backlight unit (BLU). The BLU may be classified as either a direct type or an edge type according to a position of a light source.

More recently, light emitting diodes (LEDs) having a long lifespan and which do not require a separate inverter have been used as the BLU. However, use of the LED has been limited to lighting or in displays. That is, a conventional LED is used simply as lighting, in a display, or the like.

Interest is increasing with respect to the detection of volatile organic compounds (VOCs) which may cause a sick house syndrome, as well as other odorless and colorless non-combustible gases that are harmful to a human body. According to recent research, the main cause of lung cancer in non-smoking women is reported to be non-combustible gases. Accordingly, to secure the safety of workers in a laboratory, a Fabrication (FAB), and the like, a sensor for detecting gas is typically separately installed, thereby increasing costs. In addition, since alarms for fire or gas contamination are typically sound alarms, people may have difficulty distinguishing and responding appropriately to alarms having the same or similar sounds.

It would therefore be desirable to provide an additional function, such as gas detection, to an LED lighting system.

SUMMARY

An aspect of the present disclosure provides a light emitting diode (LED) lighting system having a gas detection function, capable of optically detecting generation of gas through emission or interruption of light, color change, and the like.

According to an aspect of the present disclosure, there is provided an LED lighting system including a gas sensing apparatus including a substrate, a sensor electrode mounted on the substrate, and a sensing unit connected to the sensor electrode. The sensing unit can be made of a metal oxide. An LED package can be provided wherein an intensity of emitted light is controlled based on a voltage controlled through the gas sensing apparatus.

The LED package may include an LED chip to generate light; a phosphor layer disposed on the LED chip; and a liquid crystal display (LCD) unit to pass the light generated from the LED chip. The LCD unit can include a liquid crystal layer formed on the phosphor layer to be disposed between a first polarizing plate and a second polarizing plate.

The LED package may include a package substrate; an LED chip mounted on the package substrate; at least one lead frame inserted in the package substrate to be exposed with one end and an opposite end, wherein the one end of the at least one frame is connected to the sensor electrode included in the gas sensing apparatus and the opposite end is connected to the LED chip.

The metal oxide may include a nano structure.

The nano structure may include any of a nano wire, a nano ribbon, and a nano belt.

The metal oxide may be selected from NiO, CuO, $V_2O_5$, $In_2O_3$, MgO, CdO, $Ga_2O_3$, $WO_3$, $Cu_2O$, $Bi_2O_3$, $SnO_2$, ZnO, and $TiO_2$.

The gas sensing apparatus may include a gas detector that varies a voltage applied to the LED package according to a density of gas adsorbed to a surface of the metal oxide of the sensing unit.

The sensing unit may determine whether the gas is present when a voltage applied to the LED package is reduced and light is emitted through the first polarizing plate and the second polarizing plate.

The gas adsorbed to the sensing unit may be selected from NO, $NO_2$, $NH_3$, and $O_2$.

The sensing unit may detect the presence of the gas when a voltage applied to the LED package is increased and light is interrupted through the first polarizing plate and the second polarizing plate.

The gas adsorbed to the sensing unit may be selected from CO, $H_2$, 2-propanol, ethylene and ethanol.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1A:
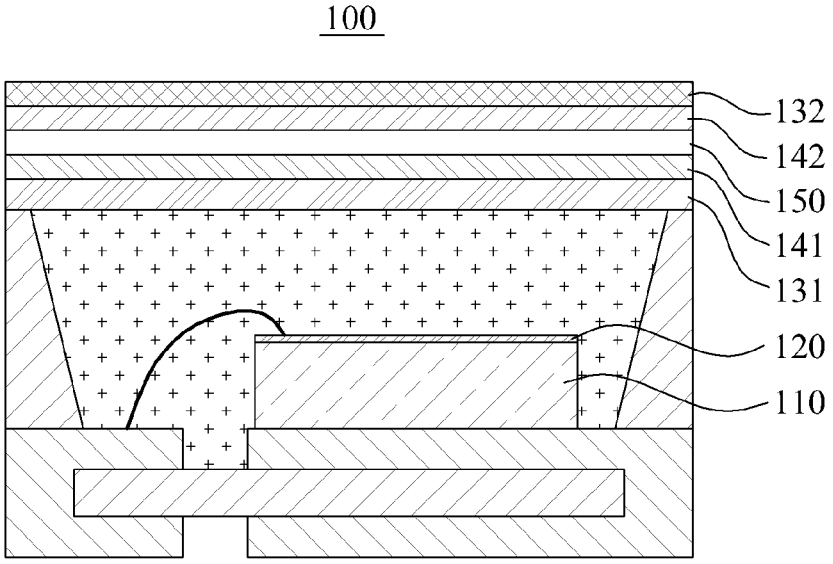
FIGS. 1A and 1B are schematic diagrams illustrating a light emitting diode (LED) package and a gas sensing apparatus used in an LED lighting system having a gas detection function, respectively, according to an embodiment of the present disclosure.

In the following description of embodiments, it will be understood that when a substrate, electrode, sensing unit, or layer is referred to as being 'on' another substrate, electrode, sensing unit, or layer, the terminology of 'on' and 'under' includes both the meanings of 'directly' and 'indirectly.' Further, the reference about 'on' and 'under' each layer will be made on the basis of drawings.

Also, in the figures, the dimensions of the elements may be exaggerated for clarity of illustration.

Reference will now be made in detail to exemplary embodiments of the present disclosure, examples of which are illustrated in the accompanying drawings, wherein like reference numerals refer to the like elements throughout. However, the present disclosure is not limited to the exemplary embodiments.

Figure 1B:
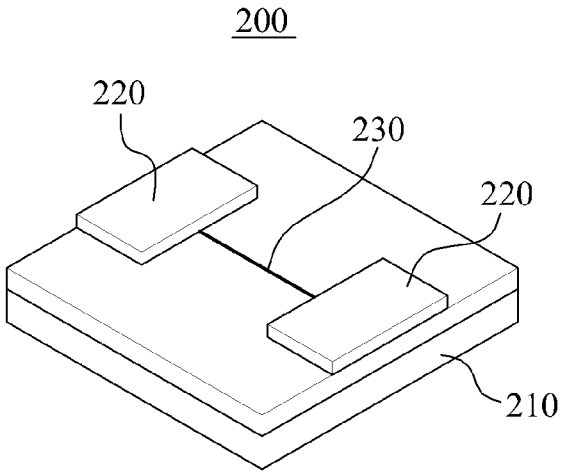

FIGS. 1A and 1B are schematic diagrams illustrating a light emitting diode (LED) package 100 and a gas sensing apparatus 200 used in an LED lighting system having a gas detection function, respectively, according to an embodiment of the present disclosure.

Referring to FIGS. 1A and 1B, the LED lighting system with a gas detection function can include the LED package 100 and the gas sensing apparatus 200.

The LED package 100 may include an LED chip 110 configured to generate light, a phosphor layer 120 disposed on the LED chip 110, and a liquid crystal display (LCD) unit including a liquid crystal layer 150. That is, the LED package 100 according to an embodiment of the present disclosure may additionally include an LCD structure.

The liquid crystal layer 150 may be disposed on the phosphor layer 120. Light generated from the LED chip 110 passes through the liquid crystal layer 150. The liquid crystal layer 150 may be disposed between a first polarizing plate 141 and a second polarizing plate 142.

Liquid crystal molecules included in the liquid crystal layer 150 have an elongated shape having different refractive indexes with respect to their long and short directions. Thus, the liquid crystal layer 150 exhibits double refraction. When light passes through such a structure, light of only a particular direction is permitted to pass. When a voltage of a sufficient level is applied, the liquid crystal molecules may be arranged in one direction such that light passing therethrough may be blocked by the polarizing plates 141 and 142.

In addition, when the voltage is interrupted or when a voltage lower than that required to orient the liquid crystal molecules in one direction is applied, the liquid crystal may be arranged in a spiral direction. Therefore, light may pass through, flowing along the spiral liquid crystal (see FIG. 5C).

The LCD may include an alignment layer (not shown) configured to orient the liquid crystals in a preferred orientation. The alignment layer may be adjacent to the liquid crystal layer 150, being disposed on the first polarizing plate 141 and the second polarizing plate 142. Since the first polarizing plate 141 and the second polarizing plate 142 only pass light oriented in a particular direction, light may be emitted to the outside or interrupted depending on a direction of the light incident to the polarizing plates 141 and 142.

A first electrode 131 and a second electrode 132 formed on a surface of the first polarizing plate 141 and a surface of the second polarizing plate 142, respectively, may each be a transparent electrode. The first electrode 131 and the second electrode 132 may, for instance, be made of indium tin oxide (ITO).

Figure 3:
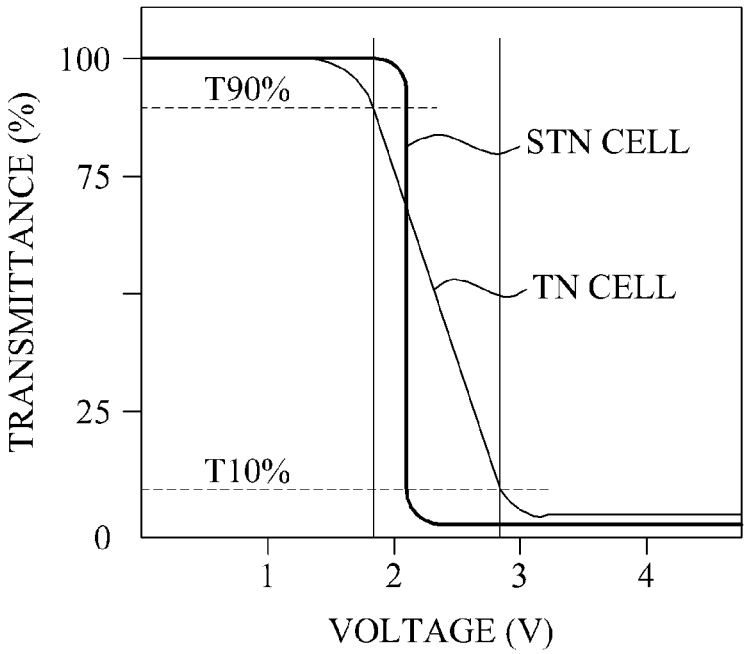
FIG. 3 is a graph illustrating transmittance of light according to a voltage applied to a liquid crystal structure to help illustrate beneficial properties of a liquid crystal display (LCD) used in an LED lighting system having a gas detection function, according to an embodiment of the present disclosure.

FIG. 3 is a graph illustrating transmittance of light in a liquid crystal structure according to an applied voltage. This graph further illustrates properties of a liquid crystal display (LCD) in an LED lighting system having a gas detection function, according to an embodiment of the present disclosure.

Referring to FIG. 3, a twisted nematic cell (TN CELL) uses nematic liquid crystal twisted by about 90°. A super twisted nematic cell (STN CELL) has a greater twist angle than the TN CELL, that is, about 180° or more. When the twist angle is increased, a tilt of electro optical characteristics is increased. As shown in FIG. 3, below a threshold voltage, liquid crystal molecules are arranged obliquely and light may pass through. However, above the threshold voltage, the liquid crystal molecules are linearly arranged and therefore light may not pass through. With respect to the present disclosure, the arrangement of the liquid crystal molecules may be varied by controlling the voltage applied to the LCD unit using the first polarizing plate 141, the second polarizing plate 142, and the gas sensing apparatus. Accordingly, the amount of light emitted from the LED package may be controlled.

In addition, according to the embodiment of the present disclosure, an alert based on the detection of gas may be provided by changing not only the amount of light but also a color of the light emitted from the LED package. When the STN CELL is used, which applies the double refraction effect by twisting molecules, light linearly polarized and incident to the liquid crystal layer may turn into elliptically polarized light. Thus, the elliptically polarized light passing through a polarizing plate may be selected as light having a particular wavelength. Therefore, when a voltage is applied, a double refraction value of the STN CELL may be changed and light having a different wavelength can be selected. As a result, information corresponding to a particular color may be displayed in the STN CELL.

In addition to the aforementioned elements, a lead frame, a wire, and the like may be included in the LED package 100 and can be similar to those used in a conventional LED package and will therefore not be described herein.

The gas sensing apparatus 200 may include a substrate 210, a sensor electrode 220 disposed on the substrate 210, and a sensing unit 230 made of a metal oxide connected to the sensor electrode 220.

The substrate 210 may include a silicon (Si) material. The substrate 210 may include a printed circuit board (PCB) including a circuit pattern for gas detection.

The sensor electrode 220 may be configured to detect a change of electrical resistance of the sensing unit 230.

The sensing unit 230 may include metal oxide. The metal oxide may be selected, for instance, from NiO, CuO, $V_2O_5$, $In_2O_3$, MgO, CdO, $Ga_2O_3$, $WO_3$, $Cu_2O$, $Bi_2O_3$, $SnO_2$, ZnO, and $TiO_2$. Since sensitivity, selectivity, and stability of the metal oxide are high, the metal oxide may provide a suitable sensor.

Also, the metal oxide of the sensing unit 230 may include a nano structure, for example, in the form of one-dimensional (1D) nano wire, nano ribbon, or nano belt. A metal oxide having such a nano structure may provide a higher surface area in the same volume, and may therefore provide an excellent gas sensor structure.

Figure 4:
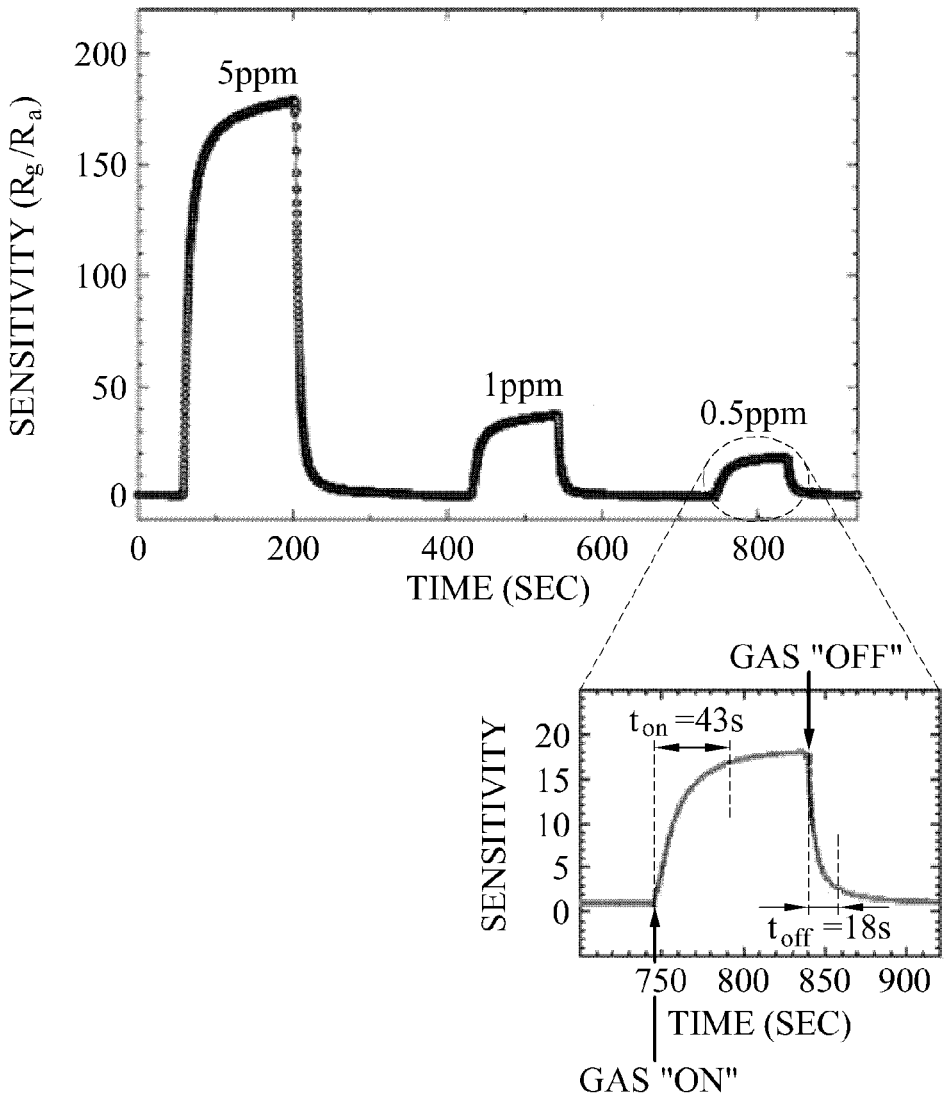
FIG. 4 is a graph illustrating sensitivity according to a time of exposure of a gas sensing apparatus included in an LED lighting system to gas, according to an embodiment of the present disclosure.

FIG. 4 is a graph illustrating sensitivity according to exposure time of a gas sensing apparatus included in an LED lighting system to gas, according to an embodiment of the present disclosure.

As shown in FIG. 4, the gas sensing apparatus has high sensitivity with respect to a gas density of about 5 ppm or 1 ppm. Even with respect to a relatively low gas density of about 0.5 ppm, the gas sensing apparatus has a sensitivity indicated by a resistance difference of approximately 17 times that in a gas "on" state as compared to a gas "off" state. Therefore, the gas sensing apparatus may perform accurate detection even when exposed to a low density gas. Also, since the gas sensing apparatus has high selectively and stability as well as high sensitivity, the gas sensing apparatus may provide exceptional sensor characteristics.

The LED lighting system according to an embodiment of the present disclosure may provide notification of the detection of gases by controlling an intensity of light emitted from a light emission surface of the LED package 100 using a voltage controlled by the gas sensing apparatus 200. Alternatively, or in addition, the LED lighting system may notify by emitting another color of light. The voltage applied to the LED package 100 may further be varied according to a density of gas adsorbed to a surface of the metal oxide of the sensing unit 230.

More specifically, when gas is adsorbed to a surface of the 1D nano structure, a resistance value of the sensing unit 230 may change according to the density of the gas. Because light is either blocked or emitted through the liquid crystal layer 150 as the voltage applied to the LCD unit of the LED package 100 is varied due to the difference in electrical signals, the LED lighting system may optically represent a detection of the gas.

Hereinafter, operation the LED lighting system providing a gas detection function according to an embodiment of the present disclosure will be described in additional detail.

Figure 2A:
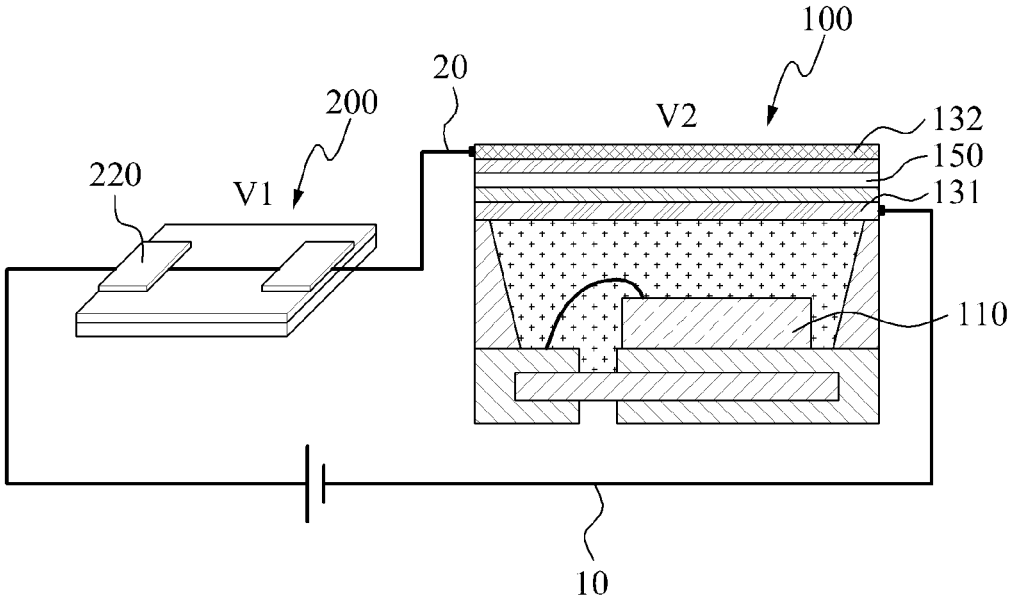
FIGS. 2A and 2B are circuit diagrams illustrating an LED package and a gas sensing apparatus being connected to each other in an LED lighting system having a gas detection function, according to an embodiment of the present disclosure.
Figure 2B:
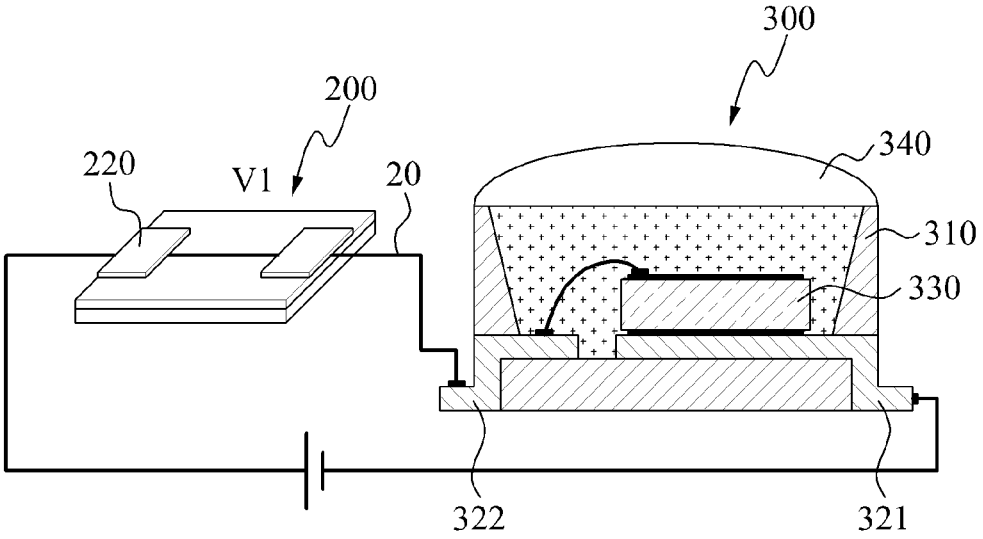

FIGS. 2A and 2B are schematic circuit diagrams illustrating the LED package 100 and the gas sensing apparatus 200 connected to each other in an LED lighting system having a gas detection function, according to an embodiment of the present disclosure.

As shown in FIG. 2A, the gas sensing apparatus 200 can include two sensor electrodes 220, which are connected with the first electrode 131 and the second electrode 132, respectively, via circuit lines 10 and 20. The first and second electrodes 131, 132 can be disposed at a lower and an upper portion of the liquid crystal layer 150, respectively.

The LED package 100, including the liquid crystal layer 150 and the gas sensing apparatus 200, may not show any response under a constant current and constant voltage. The LED package 100 can therefore be used as general lighting. More particularly, in the 1D nano structure used for the sensing unit 230, a current of tens or hundreds of μA flows under a constant voltage. Therefore, since a constant current flows in a circuit having a constant voltage, the LED lighting system may perform the same function as general lighting.

FIG. 2B is a circuit diagram illustrating an alternate embodiment in which the gas sensing apparatus 200 is directly connected with an LED package 300. Referring to FIG. 2B, the LED package 300 of this embodiment does not include the liquid crystal layer 150 of FIG. 2A. An LED 330 is mounted on a package substrate 310.

A first lead frame 321 and a second lead frame 322 may be inserted in the package substrate 310 and connected with the LED chip 330. The first lead frame 321 and the second lead frame 322 may be exposed on opposite ends. The exposed end of the first lead frame 321 and the exposed end of the second lead frame 322 may be connected with the sensor electrodes 220 included in the gas sensing apparatus 200. It should be noted, however, that the lead frame configuration (whether a single lead frame or a number of lead frames) may be varied depending on the configuration of the package substrate 310 and mounting structure of the LED chip 330.

The sensor electrodes 220 may be connected to the first lead frame 321 and the second lead frame 322 included in the LED package 300 through circuit lines 10 and 20, respectively. Again, under normal operation, because a constant current flows from the gas sensing apparatus 200 to the LED package 300, the LED package 300 operates consistently under the constant current and constant voltage. Therefore, the LED package 300 may be used as general lighting which emits uniform light through a lens unit 340. The lens unit 340 may include a diffusion lens or a transparent lens.

When gas is adsorbed to the sensing unit 230 of the gas sensing apparatus 200, the voltage applied to the LED package 300 may be varied. That is, a resistance value of the sensing unit 230 may be changed significantly based on the density of the adsorbed gas. claim idea. The resulting difference in electrical signals may cause a change in the voltage applied to the first lead frame 321 and the second lead frame 322. As a result, an intensity of the light emitted from the LED chip 330 may change, or the LED chip 330 may stop emitting light. Accordingly, by changing the intensity and/or state of the light emission from the LED package 300 based on the detection of the gas in the sensing apparatus 200, people may be notified of the presence of a harmful gas.

FIGS. 5A to 5D are diagrams illustrating operation of an LED lighting system having a gas detection function, according to an embodiment of the present disclosure.

Referring to 5A to 5D, a reaction of when molecules of gas such as NO or $NO_2$ are adsorbed to a surface of the metal oxide of the sensing unit 230 may be expressed as follows.

NO+*e*− NO− [Reaction formula 1]

Figure 5A:
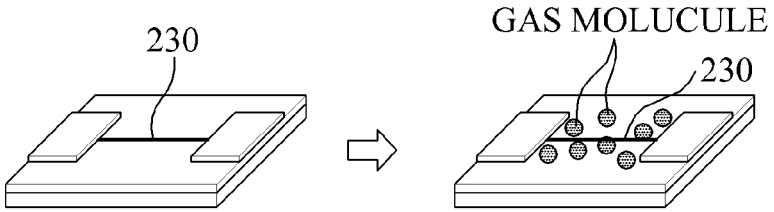
FIGS. 5A to 5D are schematic diagrams illustrating operation of an LED lighting system having a gas detection function, according to an embodiment of the present disclosure.
Figure 5B:
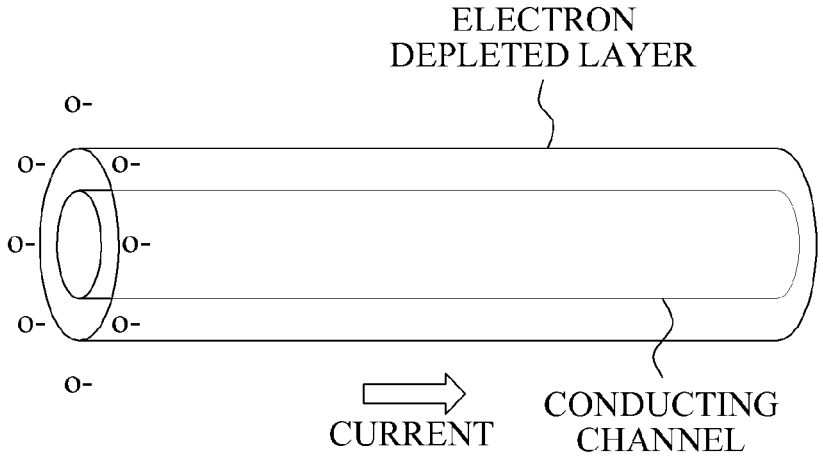

Here, when the gas molecules are adsorbed to the surface of the metal oxide and receive surface charges as shown in FIG. 5A, an electron depleted layer may be generated at an outer side of a conducting channel as shown in FIG. 5B. Finally, electrical conductivity may be reduced, thereby increasing the resistance.

Figure 5C:
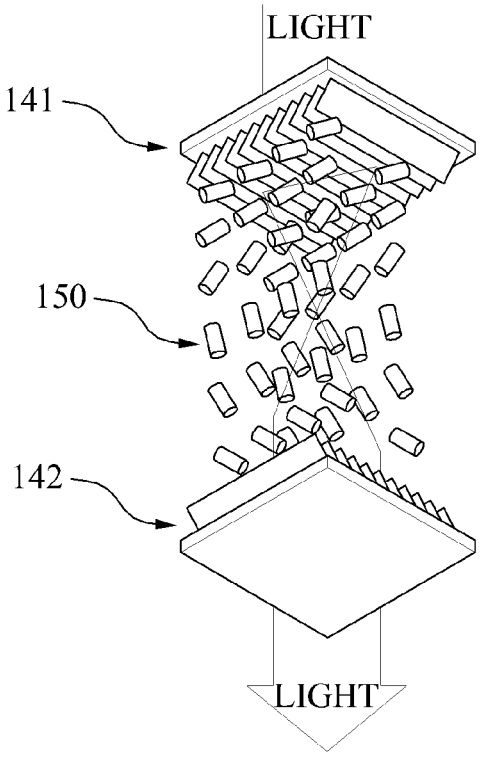
Figure 5D:
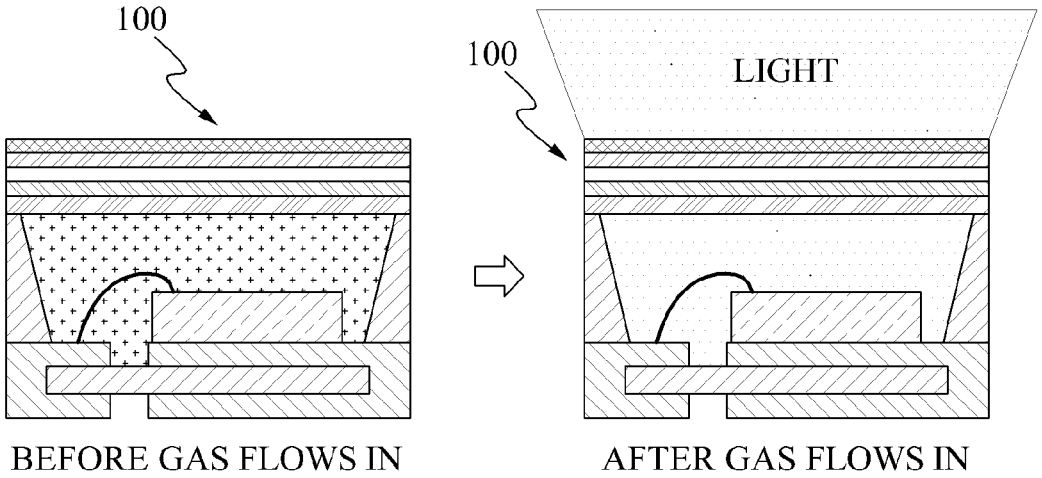

Therefore, a voltage V1 shown in FIG. 2, which is applied to the gas sensing apparatus 200 including the sensing unit 230, may be increased compared to before the gas flows in. That is, liquid crystal of the liquid crystal layer 150 is arranged regularly and not emitted to the outside before the gas flows in. However, since a voltage V2 shown in FIG. 2 of after the gas flows in is relatively lower than the voltage V1, the liquid crystal is arranged spirally or obliquely as shown in FIG. 5C, thereby emitting light to an upper portion as shown in FIG. 5D. Accordingly, presence of molecules of the harmful gas such as NO or $NO_2$ may be recognized.

Since the resistance value is varied according to the density of the gas molecules, the voltage V1 or voltage V2 may be varied according to the density of the gas so that the light is emitted only at a predetermined density or higher.

Figure 7:
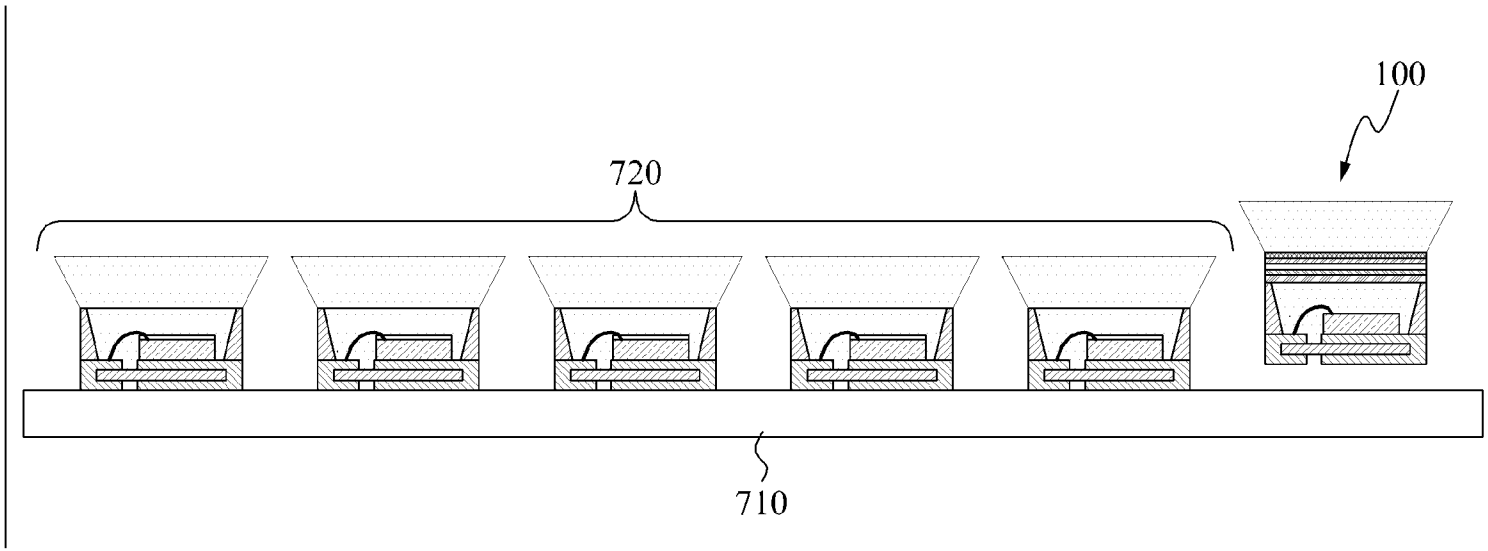
FIG. 7 is a schematic diagram illustrating an example of an LED lighting system having a gas detection function, according to an embodiment of the present disclosure.

The gas detection function that emits light by inflow of gas may be applied to a single gas sensor. Also, in an L-tube or flat panel lighting type in which a plurality of LEDs 720 are mounted on a circuit board 710 as shown in FIG. 7, the gas detection function may be applied along with lighting by mounting the LED package 100 for gas detection at a predetermined portion. Although only the LED package 100 for gas detection is shown in FIG. 7, the LED package 100 may operate in association with the gas sensing apparatus 200 of FIG. 1.

In addition, the gas detection function may not only control light emission and interruption but also transmit an alarm message through change of colors using red, green, and blue LED chips used in the LED package 100 for gas detection.

FIGS. 6A to 6D are diagrams illustrating operations of an LED lighting system having a gas detection function, according to another embodiment of the present disclosure.

Referring to FIGS. 6A to 6D, a reaction of when molecules of gas such as CO or $H_2$ are adsorbed to the surface of the metal oxide of the sensing unit 230 may be expressed as follows.

$$CO+O- CO_2+e- \quad \text{[Reaction formula 2]}$$

Figure 6A:
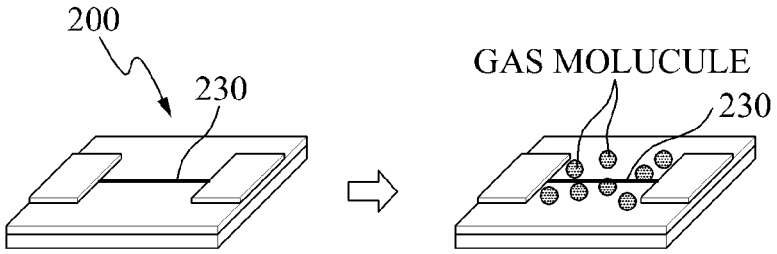
FIGS. 6A to 6D are schematic diagrams illustrating operation of an LED lighting system having a gas detection function, according to another embodiment of the present disclosure.
Figure 6B:
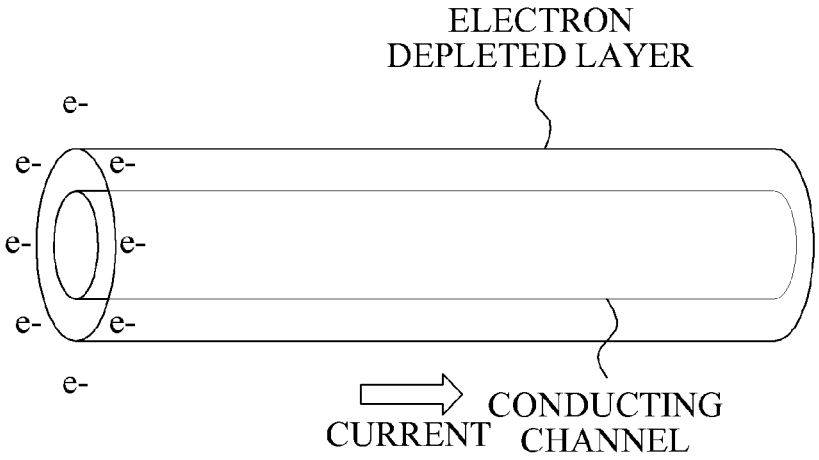

In an environment with sufficient oxygen as shown in FIG. 6A, the molecules such as CO or $H_2$ give electrons to the surface of the metal oxide. Therefore, electrical conductivity of the conducting channel may be increased, thereby reducing the resistance.

Figure 6C:
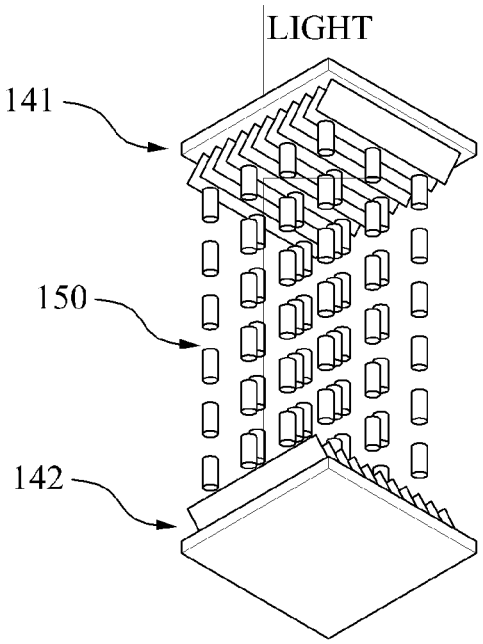

Thus, since the electrical conductivity increases and the resistance decreases, the operation becomes different from in FIG. 5A. That is, the voltage V1 shown in FIG. 2, applied to the gas sensing apparatus 200 including the sensing unit 230, is decreased compared to before the gas flows in. Finally, light is emitted to the upper portion of the liquid crystal of the LED package 150 before the gas flows in. However, after the gas flows in, because the voltage V2 shown in FIG. 2 is relatively increased, the liquid crystal is regularly arranged as shown in FIG. 6C and therefore light is not emitted to the outside. Thus, presence of molecules of non-combustible gas such as CO or $H_2$ may be recognized.

Figure 6D:
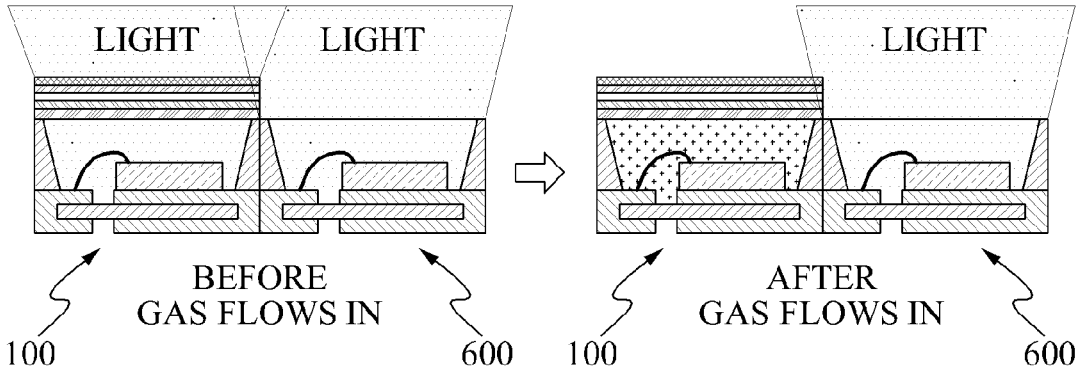

The gas detection function that interrupts light by inflow of gas may be applied to a single gas sensor or an L-tube type. Here, an alarm message may be transmitted through change of a color temperature and a color rendering index (CRI) of entire lighting using red, green, and blue LED chips. As shown in FIG. 6D, an LED lighting system having the gas detection function may be constructed by combining the LED package 100 for gas detection and an LED package 600 for lighting. When the red LED chip is applied to the LED package 600 for lighting, the light may be changed from warm white to cool white after gas adsorption. When the blue LED chip is applied, the light may be changed from cool white to warm white after gas adsorption.

That is, oxidation or reduction is determined according to a type of the gas inflow. The gas inflow may change the resistance of the metal oxide and also the voltage supplied to an LCD unit. Accordingly, light may be emitted through the LCD unit or interrupted.

Thus, an LED lighting system having a gas detection function according to the embodiments of the present disclosure may be used not only for lighting but also for detecting volatile organic compounds (VOCs) causing a sick house syndrome and odorless and colorless non-combustible harmful gas, at home. That is, the LED lighting system may be used as an optical sensor with fast response and high sensitivity with respect to an environment harmful to a human body.

In addition, whereas conventional alarms for fire and gas contamination are perceived by sound, the embodiments of the present disclosure enable determination of presence of gas easily through a color change. Therefore, emergency may be effectively dealt with.

In addition, without having to separately purchase a product functioning as a sensor to protect workers in a laboratory, a Fabrication (FAB), and the like, the LED lighting system according to the embodiments of the present disclosure may be applied together with lighting necessary in daily life. Accordingly, cost may be reduced and presence of gas may be easily detected through a change of color.

Furthermore, since the conventional alarms for fire and gas contamination are all the same sound, people may difficult to separately cope with the fire and the gas contamination. However, according to the embodiments, generation of harmful gas may be recognized by change of brightness and color of light through emission or interruption of the light. Accordingly, more effective dealing may be achieved.

Although a few exemplary embodiments of the present disclosure have been shown and described, the present disclosure is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A light emitting diode (LED) lighting system comprising:

a gas sensing apparatus including a substrate, a sensor electrode mounted on the substrate, and a sensing unit connected to the sensor electrode and made of a metal oxide; and an LED package to control intensity of emitted light by a voltage controlled through the gas sensing apparatus, wherein the LED package comprises:

an LED chip configured to generate light;

a phosphor layer disposed on the LED chip; and a liquid crystal display (LCD) unit to pass the light generated from the LED chip, the LCD unit including a liquid crystal layer formed on the phosphor layer to be disposed between a first polarizing plate and a second polarizing plate.

2. The LED lighting system of claim 1, wherein the LED package comprises: a package substrate; an LED chip mounted on the package substrate; at least one lead frame inserted in the package substrate to be exposed with one end and an opposite end, wherein the one end of the at least one lead frame is connected to the sensor electrode included in the gas sensing apparatus and the opposite end is connected to the LED chip.

3. The LED lighting system of claim 1, wherein the metal oxide comprises a nano structure.

4. The LED lighting system of claim 1, wherein the nano structure comprises a nano wire, a nano ribbon, or a nano belt.

5. The LED lighting system of claim 1, wherein the metal oxide is chosen from NiO, CuO, V2O5, In2O3, MgO, CdO, Ga2O3, WO3, Cu2O, Bi2O3, SnO2, ZnO, and TiO2.

6. The LED lighting system of claim 1, wherein the gas sensing apparatus is configured to vary a voltage applied to the LED package according to a density of gas adsorbed to a surface of the metal oxide of the sensing unit.

7. The LED lighting system of claim 6, wherein the sensing unit determines whether the gas is generated when a voltage applied to the LED package is reduced and therefore light is emitted through the first polarizing plate and the second polarizing plate.

8. The LED lighting system of claim 6, wherein the gas adsorbed to the sensing unit is selected from NO, $NO_2$, $NH_3$, and $O_2$.

9. The LED lighting system of claim 6, wherein the sensing unit determines whether the gas is generated when a voltage applied to the LED package is increased and therefore light is interrupted through the first polarizing plate and the second polarizing plate.

10. The LED lighting system of claim 9, wherein the gas adsorbed to the sensing unit is selected from CO, $H_2$, 2-propanol, ethylene, and ethanol.

* * * * *